US007367461B2

(12) United States Patent
Waisanen

(10) Patent No.: US 7,367,461 B2
(45) Date of Patent: May 6, 2008

(54) MOVABLE GIRDER MOUNTED JIB

(75) Inventor: Steven K. Waisanen, Big Bend, WI (US)

(73) Assignee: MHE Technologies, Inc., Wilmington, DE (US)

( * ) Notice: Subject to any disclaimer, the term of this patent is extended or adjusted under 35 U.S.C. 154(b) by 1 day.

(21) Appl. No.: 11/416,969

(22) Filed: May 3, 2006

(65) Prior Publication Data

US 2006/0283825 A1 Dec. 21, 2006

Related U.S. Application Data

(60) Provisional application No. 60/688,440, filed on Jun. 8, 2005.

(51) Int. Cl.
*B66C 23/26* (2006.01)

(52) U.S. Cl. ..... 212/175; 212/177; 212/179; 212/270

(58) Field of Classification Search ..... 212/175, 212/176, 179, 177, 270
See application file for complete search history.

(56) References Cited

U.S. PATENT DOCUMENTS

| | | | | |
|---|---|---|---|---|
| 72,801 | A | | 12/1867 | Coffman |
| 97,114 | A | | 11/1869 | Piper et al. |
| 1,138,007 | A | | 5/1915 | Newell |
| 1,175,049 | A | * | 3/1916 | Cull ..... 212/202 |
| 1,354,745 | A | | 10/1920 | Henderson |
| 1,374,837 | A | * | 4/1921 | Dykes ..... 212/179 |
| 2,696,917 | A | * | 12/1954 | Kershaw ..... 212/179 |
| 3,053,398 | A | * | 9/1962 | Liebherr et al. ..... 212/176 |
| 3,245,355 | A | | 4/1966 | Cousins et al. |
| 3,358,849 | A | | 12/1967 | Becker |
| 3,516,555 | A | | 6/1970 | Robertson et al. |
| 3,651,951 | A | | 3/1972 | Murakami |
| 3,789,565 | A | * | 2/1974 | Lindholm ..... 52/745.01 |
| 4,421,242 | A | * | 12/1983 | Brueske ..... 212/325 |
| 4,511,048 | A | | 4/1985 | Volakakis et al. |
| 4,685,535 | A | * | 8/1987 | Bush et al. ..... 182/63.1 |
| 4,688,688 | A | | 8/1987 | Volakakis et al. |
| 4,757,592 | A | * | 7/1988 | Reed ..... 29/429 |
| 5,417,018 | A | * | 5/1995 | Matsumoto et al. ..... 52/123.1 |

FOREIGN PATENT DOCUMENTS

JP 8-245174 * 9/1996

* cited by examiner

*Primary Examiner*—Thomas J. Brahan
(74) *Attorney, Agent, or Firm*—Porter, Wright, Morris & Arthur, LLP

(57) ABSTRACT

A portable jib for movably mounting to a crane girder includes a base frame configured for traveling along a girder and a support member coupled to the base frame, wherein the support member extends substantially upward from the base frame. A boom is coupled to a free end of the support member and the boom extends substantially radially outward from the support member. The base frame, the support member and the boom are assembled and mounted to the girder for use and disassembled and removed from the girder after use.

25 Claims, 5 Drawing Sheets

MOVABLE GIRDER MOUNTED JIB

CROSS-REFERENCE TO RELATED APPLICATION

This application claims priority from U.S. Provisional Patent Application No. 60/688,440, entitled "Movable Girder Mounted Jib", filed Jun. 8, 2005 by Steven K. Waisanen.

BACKGROUND

The present invention relates to a portable jib, and more particularly, a movable girder mounted jib.

Conventional overhead cranes include a frame with a pair of bridge cross members that move along a pair of main support beams. A pair of rails are supported by the cross members and a trolley and/or a hoist moves along the rails in a direction transverse to the main support beams. These cranes are often used inside containment areas of nuclear power plants and other facilities. Typically these facilities do not include lifting devices positioned above the crane for raising and lowering loads to and from the crane during modernization, installation and removal processes. In facilities that do include a lifting device, the location in which loads or unloads are made and where materials are located on the crane bridge are very limited.

SUMMARY

In one embodiment, the invention provides a portable jib for movably mounting to a crane girder. The portable jib includes a base frame configured for traveling along a girder and a support member coupled to the base frame. The support member extends substantially upward from the base frame. A boom is coupled to a free end of the support member and the boom extends substantially radially outward from the support member. The base frame, the support member and the boom are assembled and mounted to the girder for use and disassembled and removed from the girder after use.

In another embodiment, the invention provides a portable jib for movably mounting to a crane girder. The portable jib includes a base frame configured for traveling along a girder. The base frame includes a pair of end trucks spaced apart and mounted to opposite sides of the girder, each end truck having at least one wheel for traveling along the girder. A support member is coupled to the base frame, the support member including a support bar extending between and coupled to the end trucks and a mast extending substantially upward from the support bar. A boom is rotatably coupled to a free end of the mast and includes an attachment means at a free end of the boom, wherein the boom extends substantially radially outward from the mast. The base frame, the support member and the boom are assembled and mounted to the girder for use and disassembled and removed from the girder after use.

In another embodiment, the invention provides a method of removing and installing components of a crane, the crane including a girder. The method includes assembling a portable jib on the girder of the crane wherein the jib is configured for traveling along the girder, coupling a hoist to the jib, the hoist for raising and lowering loads to and from the crane, utilizing the hoist to raise a load to the crane or lower a load from the crane, and disassembling the jib and removing the jib from the girder.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
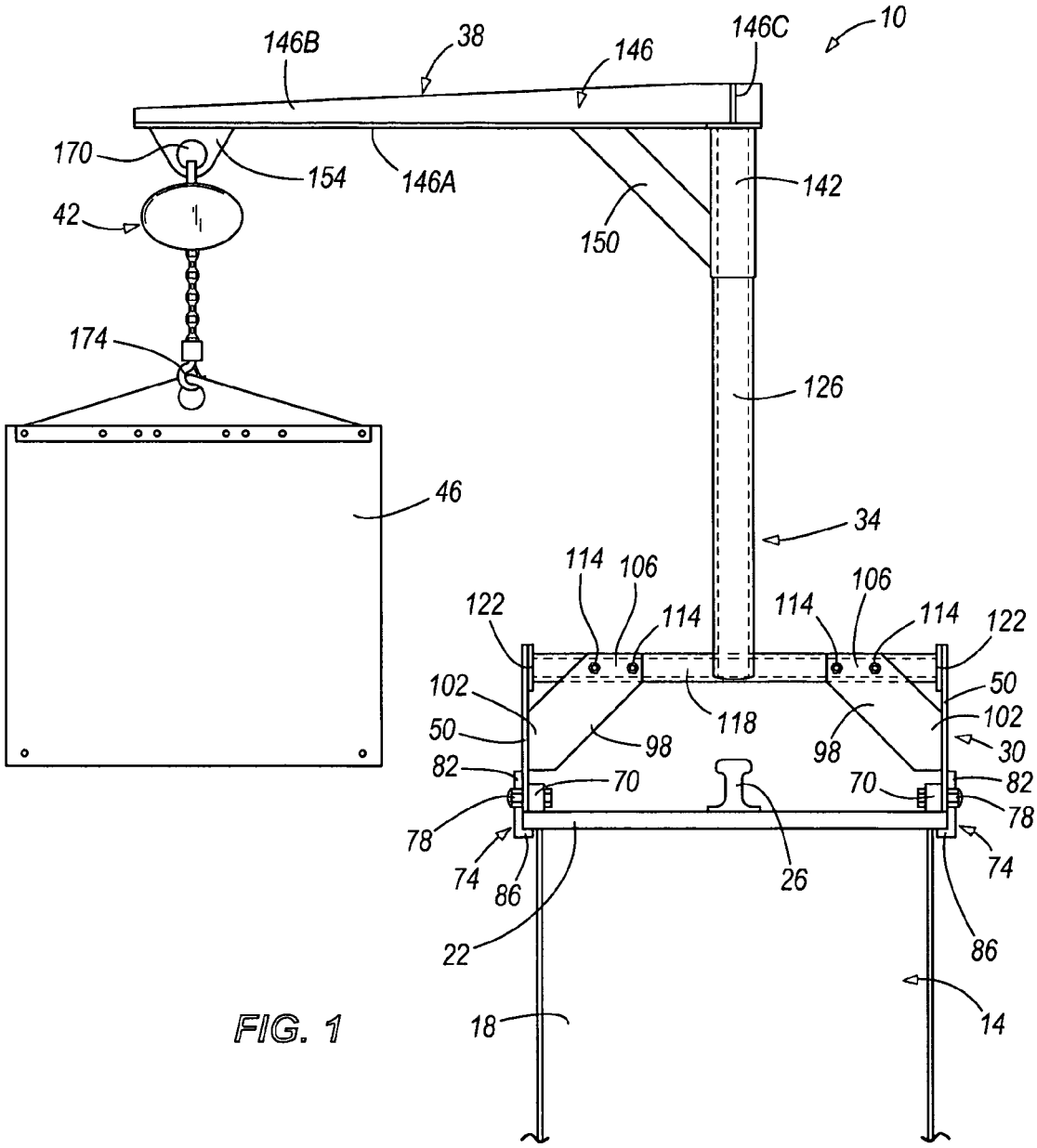
FIG. 1 is a side view of a portable jib according to one embodiment of the invention, the jib movably mounted to a girder.
Figure 2:
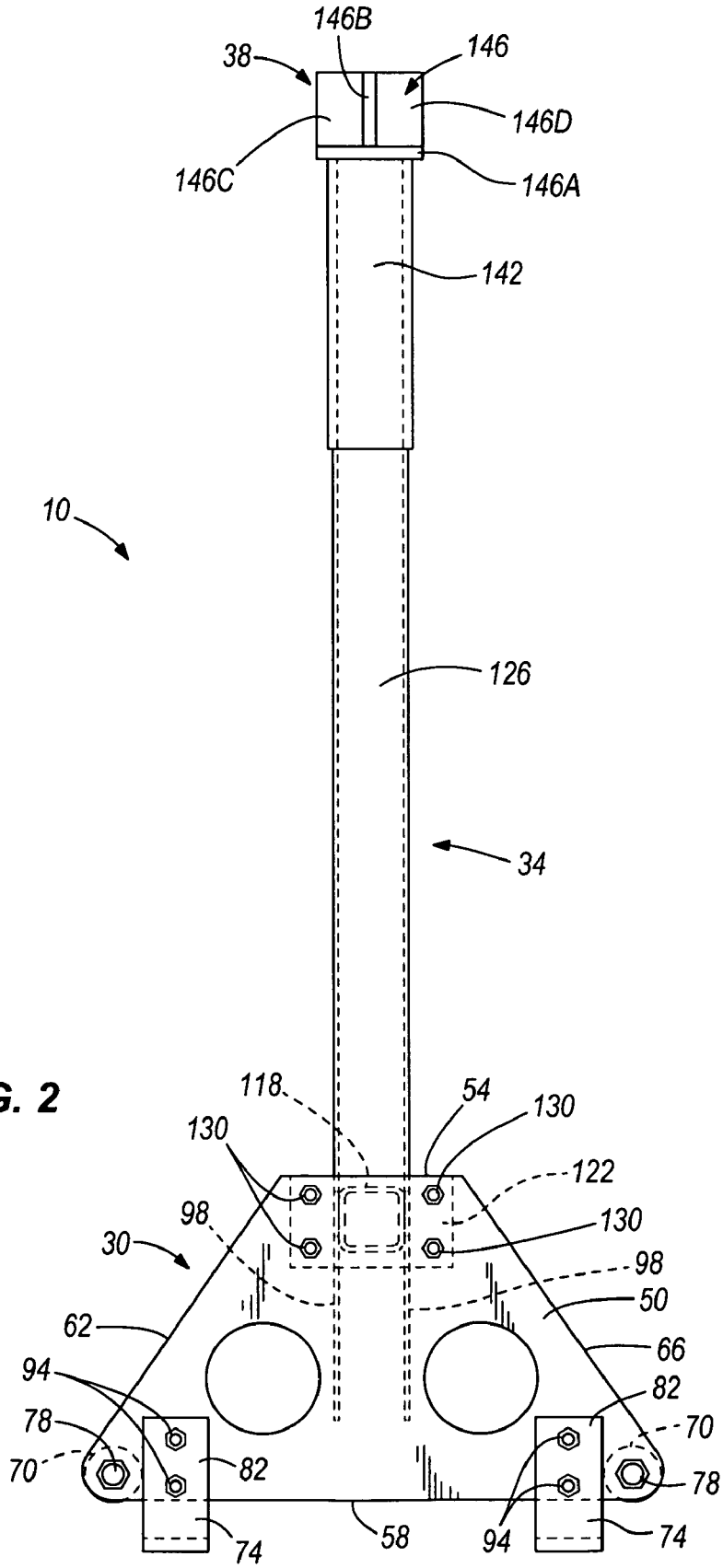
FIG. 2 is an end view of the portable jib shown in FIG. 1.
Figure 3:
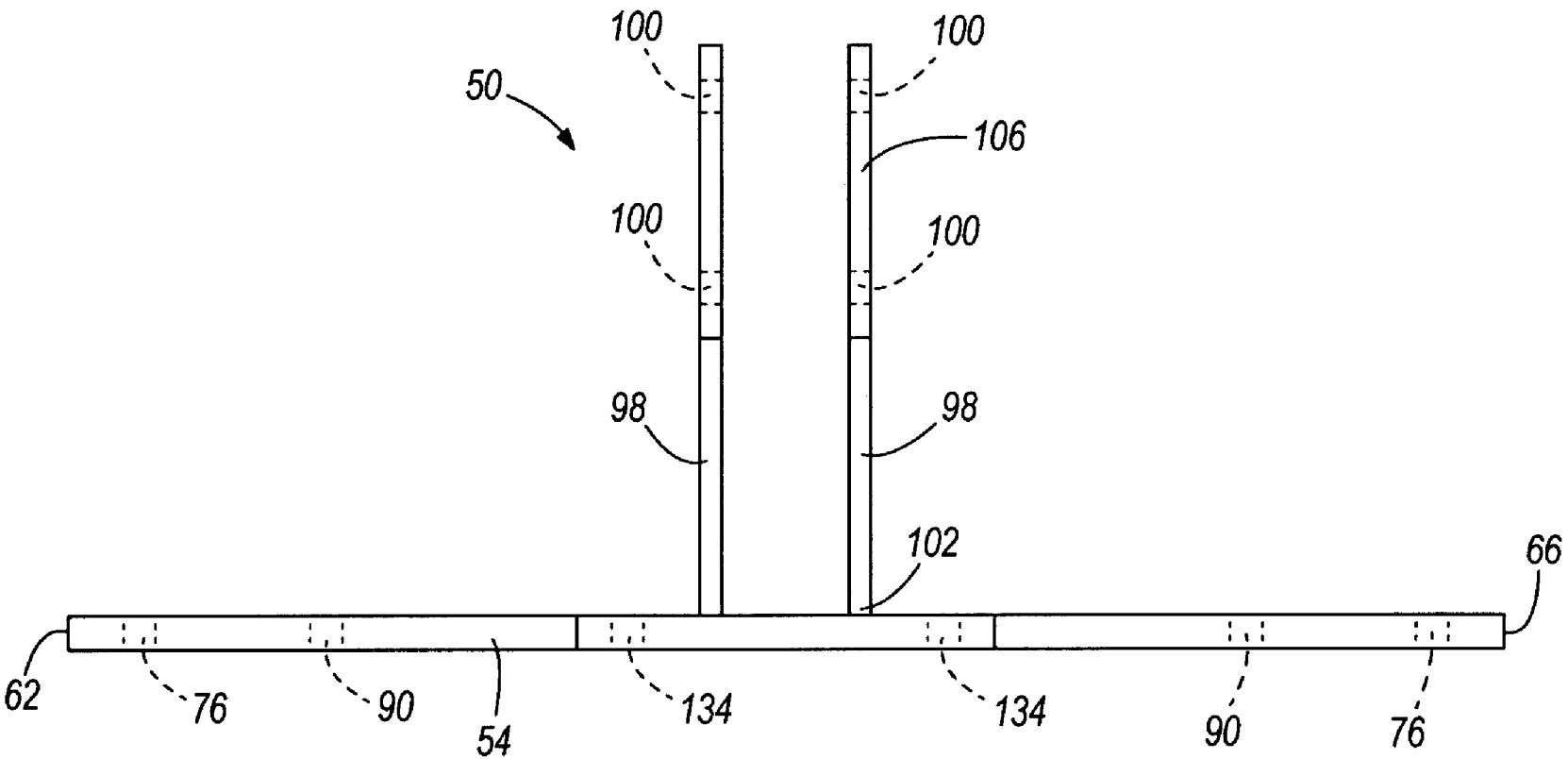
FIG. 3 is a top view of a base frame of the portable jib shown in FIG. 1.
Figure 4:
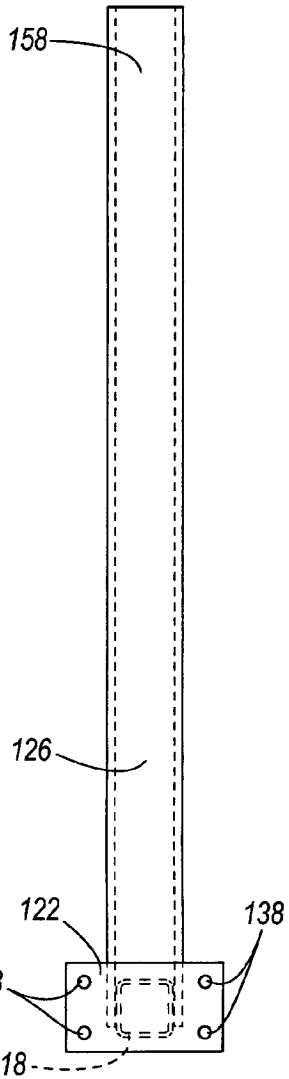
FIG. 4 is an end view of a support member of the portable jib shown in FIG. 1.
Figure 5:
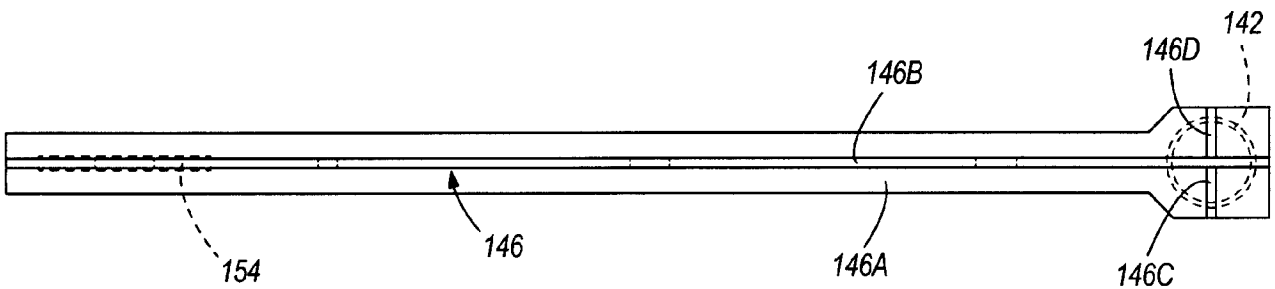
FIG. 5 is a top view of a boom of the portable jib shown in FIG. 1.

FIGS. 1 and 2 illustrate one embodiment of a portable jib 10 for movably mounting to a girder 14 of a crane (not shown), and FIGS. 3-5 illustrate components of the jib 10. The jib 10 provides an ability to raise and lower loads to and from a crane while performing modernization installation or removal work without the need for lifting equipment positioned above the crane. Further, the jib 10 is configured and adapted to roll along a top of the crane girder 14 such that the jib 10 may be easily positioned where load lifts need to be made and positioned accurately to eliminate inefficiencies associated with personnel handling. The girder 14 shown in FIG. 1 includes a beam 18 having an upper portion 22 and a girder rail 26 positioned on the upper portion 22 of the beam 18. The jib 10 includes a base frame 30 mounted to the girder 14, a support member 34 coupled to the base frame 30, and a boom 38 rotatably coupled to the support member 34. In use, a hoist 42 is attached to the boom 38 for raising and lowering loads, and a rigging device 46 is attached to the hoist 42 to facilitate attachment of a load to the hoist 42.

Referring to FIGS. 1, 2 and 3, the base frame 30 includes a pair of end trucks 50, or, base plates, spaced apart and opposed to one another. Each end truck 50 has a generally trapezoidal shape with an upper edge 54, a lower edge 58 opposite the upper edge 54, and side edges 62, 66 connecting the upper and lower edges 54, 58. It should be readily apparent to those of skill in the art that the end trucks 50 may have other shapes, such as rectangular, triangular, or the like.

Referring to FIGS. 1 and 2, each end truck 50 includes a pair of wheels 70 and a pair of guide plates 74 adjacent the lower edge 58 of the end truck 50 to facilitate travel and guide the jib 10 along the girder 14. The wheels 70 are coupled to the end truck 50 at apertures 76 adjacent the lower edge 58 by a fastener 78, such as a screw and nut, although other known fastening means may be used. As shown in FIG. 1, the wheels 70 are positioned to travel along the upper portion 22 of the girder 14, and thereby move the jib 10 along the girder 14. In a further embodiment, fewer or more wheels 70 may be coupled to each end truck 50 to facilitate travel. In a preferred embodiment, the wheels 70 are idle such that a user may push the jib 10 along the girder 14 as needed, although in another embodiment driven wheels may be used.

Each guide plate 74 is generally L-shaped and includes a first, mount portion 82 and a second, guide portion 86. The mount portion 82 of the guide plate 74 is coupled to the end truck 50 at apertures 90 (FIG. 3) adjacent the lower edge 58 by fasteners 94, such as a screw and nut (not shown), although other known fastening means may be used. The mount portion 82 extends generally downward from the end truck 50 and the guide portion 86 extends substantially perpendicular to the mount portion 82 and generally inward towards a center axis of the end truck 50. The guide plate 74 complements the shape of the girder 14 such that in use each guide plate 74 receives the upper portion 22 of the girder 14 to guide the jib 10 along the girder 14. In a further embodiment, fewer or more guide plates 74 may be coupled to each end truck 50.

Each end truck 50 includes a pair of support plates 98 extending radially outwardly and upwardly from the end truck 50. A first end 102 of each support plate 98 is mounted to the end truck 50 by known mounting means, such as welding, and a second end 106 of each support plate 98 is coupled to the support member 34 at apertures 100, as discussed below. In further embodiments, the end trucks 50 with support plates 98 are formed by other fabrication techniques, such as extrusion, molding, or the like. The support plates 98 provide additional support for the support member 34 and help maintain the support member 38 upright relative to the base frame 30. In the illustrated embodiment, each support plate 98 is coupled to the support member 34 by fasteners 114, such as a screw and nut (not shown), although other known fastening means may be used. In a further embodiment, fewer or more support plates 98 are included on each end truck 50. The end trucks 50 and the support plates 98 are formed from steel, although in further embodiments other types of materials may be used.

Referring to FIGS. 1, 2 and 4, the support member 34 includes a support bar 118, a pair of brackets 122, and a mast 126, all of which are formed from steel, although in further embodiments other types of materials may be used. The support bar 118 is coupled to and extends between the end trucks 50 of the base frame 30. A bracket 122 is mounted to each end of the support bar 118, for example by welding, and is used for coupling the support member 34 to the base frame 30. In the illustrated embodiment, the brackets 122 are coupled to the respective end truck by four fasteners 130, such as a screw and nut (not shown), although fewer or more fasteners 130 may be used and other known fastening means may be used. Apertures 134 (FIG. 3) formed in the end truck 50 and apertures 138 (FIG. 4) formed in the bracket 122 receive the fasteners 134 for coupling the support member 34 to the base frame 30.

The mast 126 of the support member 34 is mounted to the support bar 118 and extends generally perpendicular and upward from the support bar 118. For example, the mast 126 may be mounted to the support bar 118 by welding, although other known mounting means may be used. Other techniques for fabricating the mast 126 and the support bar 118 may be used as well, such as extrusion, molding, or the like. In the illustrated embodiment, the support bar 118 is formed by a generally square tube and the mast 126 is formed by a generally round tube having a first diameter, although in a further embodiment the support bar 118 and the mast 126 may have other shapes and may be formed from solid bars. Referring to FIG. 1, the mast 126 has a height of about 55 inches, such that the jib 10 has an overall height of 72.5 inches.

Referring to FIGS. 1, 2, and 5, the boom 38 is generally L-shaped and includes a coupling member 142, a load arm 146, a brace plate 150, and a hoist plate 154. In the illustrated embodiment, the boom 38 is formed from steel, although in other embodiments the boom or individual boom components may be formed from other types of materials. The load arm 146 is coupled to the coupling member 142, for example by welding, and extends substantially perpendicular to the coupling member 142. The coupling member 142 is formed by a generally round tube having a second diameter greater than the first diameter of the mast 126. To couple the boom 38 to the support member 34, the coupling member 142 receives a free end 158 of the mast 126 such that the boom 38 is rotatable about the mast 126. The coupling member 142 is sized to freely rotate about the mast 126, however, the coupling member 142 has a length sufficient to prevent the boom 38 from falling off the support member 34 and keep the boom 38 steady and sturdy relative to the support member 34. It should be readily apparent to those of skill in the art, that other means for coupling or rotatably coupling the boom 38 to the support member 34 may be used.

In the illustrated embodiment, the load arm 146 is formed by four plates 146A-146D. A first plate 146A is coupled to the coupling member 142 and extends substantially perpendicular to the coupling member 142. A second plate 146B is coupled to the first plate 146A and extends substantially perpendicular to a longitudinal axis of the first plate 146A. Third and fourth plates 146C, 146D are located at a coupling end 162 of the load arm 146 and extend outward and in opposite directions from the second plate 146B. The third and fourth plates 146C, 146D are coupled to the first plate 146A and the second plate 146B. It should be readily apparent to those of skill in the art that the load arm may have other configurations including fewer or more plates, a tube, a bar, or the like. Further, that the load arm 146 may be formed by other fabrication techniques, such as, but not limited to, extrusion or molding.

The boom 38 includes the brace plate 150 to help support the load arm 146 relative to the coupling member 142. The brace plate 150 extends radially outwardly and upwardly from the coupling member 142 to the coupling end 162 of the load arm 146 and is coupled to both the coupling member 142 and the load arm 146. In the illustrated embodiment, the brace plate 150 extends from the coupling member 142 at about 45°. It should be readily apparent to those of skill in the art, that in further embodiments other means or plate configurations and shapes may be used to support the load arm 146 relative to the coupling member 142, such as a tube, bar, or the like.

The hoist plate 154 is coupled to a free end 166 of the load arm 146. The hoist plate 154 includes an aperture 170 and the hoist 42 is attached to the hoist plate 154 through the aperture 170. It should be readily apparent to those of skill in the art that other means may be used to attach the hoist 42 to the boom 38 and the hoist 42 may be attached at other positions along the load arm 146. In the illustrated embodiment, the hoist 42 is a chain hoist including a hook 174 and the hook 174 supports the rigging device 46, which is used to secure loads to the hoist 42. In further embodiments, other types of hoists or configurations for lifting may be used, and a rigging device may not used to help raise and lower loads.

Figure 6:
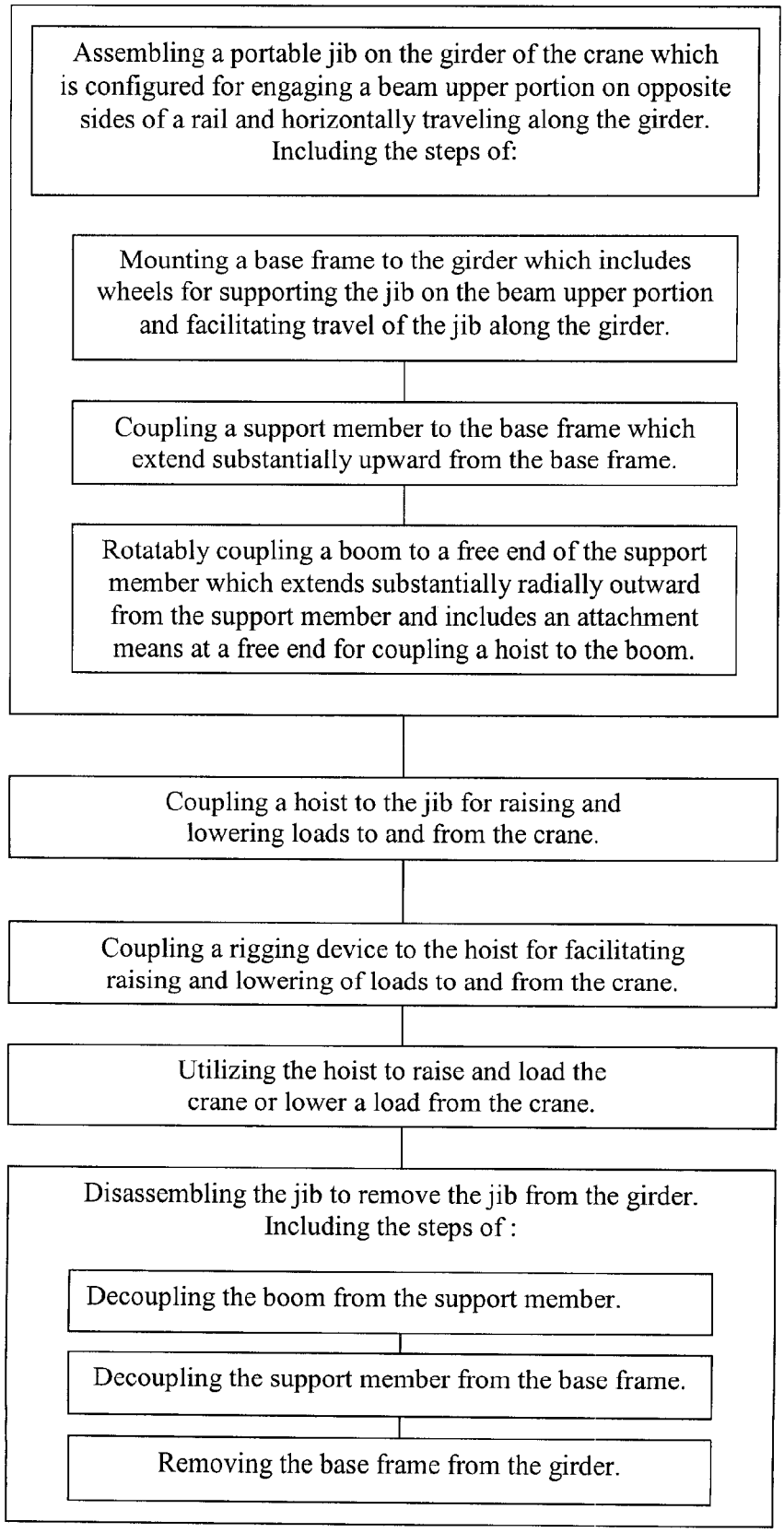
FIG. 6 is a block diagram showing a method of removing and installing components of a crane according to one embodiment of the invention.

FIG. 6, illustrates a method of removing and installing components of a crane according to one embodiment of the invention. In order to complete installation or removal processes, the portable jib 10 is assembled on the girder 14 of the crane bridge (not shown). To assemble the jib 10, each end truck 50 is mounted to the girder such that the guide plates 74 receive the upper portion 22 of the girder 14 and the wheels 70 are positioned to travel along the girder 14. The support bar 18 of the support member 34 is then coupled to the end trucks 50 and extends between the end trucks 50. Each bracket 122 of the support bar 188 is fastened to one of the end trucks 50, as described above. In addition, the support plates 98 extending from the end trucks 50 are fastened to the support bar 118 of the support member 34. Next, the boom 38 is rotatably coupled to the support member 34 by sliding the coupling member 142 over the free end 158 of the support member mast 126. That is, the tube of the coupling member 142 received the tube of the mast 126 and rests upon the mast 126

Once the portable jib 10 is assembled on the bridge girder 14, the hoist 42 is attached to the hoist plate 154 of the boom 38. The rigging device 46 is then attached to the hook 174 of the hoist 42. In a further embodiment, the hoist 42 may be permanently coupled to the boom 38. It should be readily apparent to those of skill in the art that the rigging device 46 is not necessary for all applications of the portable jib 10.

In operation, to install a component on the crane, the hoist 42 is lowered until the hoist hook 174 or the rigging device 46 reaches a facility floor, ground or other support surface. A component is attached to the hoist 42 or the rigging device 46, and the hoist 42 is then raised until the component reaches the crane. An operator removes the component from the hoist 42 or the rigging device 46 for installation on the crane. To remove a component on the crane, the hoist 42 is raised until the hoist hook 174 or the rigging device 46 reaches the crane. A component on the crane is removed and attached to the hoist hook 174 or placed on the rigging device 46. The hoist 42 is then lowered until the component reaches the floor of the facility. It should be readily apparent to those of skill in the art that the portable jib 10 may be used for other processes associated with or near the crane beyond installation and removal of components.

The portable jib 10 is configured and adapted to roll along a top of the bridge girder 14 such that the jib 10 is easily positionable where load lifts need to be made and accurately positioned to eliminate inefficiencies associated with personnel handling. Once use of the jib 10 is complete, the jib 10 is dissembled and removed from the bridge girder 14. Therefore, a user may carry the jib 10 on and off a crane, and the crane is portable for use with multiple cranes. In one embodiment, the assembled jib 10 weighs about 360 pounds, with individual components weighing no more than 80 pounds. The jib 10, assembled or disassembled, is light enough such that no lifting equipment is required to place or remove the jib 10 relative to the crane. The jib 10 is easy to carry to and from the crane site, yet has a capacity to handle the heaviest items requiring lifting.

Various features and advantages of the invention are set forth in the following claims.

What is claimed is:

1. A portable jib for movably mounting to a crane girder including a beam having an upper portion and a rail positioned on the upper portion, the portable jib comprising:

a base frame configured for traveling along the girder;

wherein the base frame comprises a pair of end trucks spaced apart and located on opposite sides of the rail;

wherein each end truck includes at least one wheel for supporting the base frame on the beam upper portion on opposite sides of the rail and horizontally traveling along the girder;

wherein each end truck includes at least one guide plate extending inwardly below the beam upper portion to receive the beam upper portion for mounting the base frame to the girder and guiding the base frame along the girder;

a support member coupled to the base frame, wherein the support member extends substantially upward from the base frame;

a boom coupled to a free end of the support member, the boom extending substantially radially outward from the support member; and wherein the base frame, the support member and the boom are assembled on the girder for use and disassembled for removal from the girder after use.

2. The portable jib of claim 1, and further comprising a support plate mounted to each end truck, each support plate extending between the respective end truck and the support member.

3. The portable jib of claim 1, wherein the support member comprises a support bar configured for coupling to the base frame, and a mast extending substantially upward from the support bar, the mast defining the free end of the support member.

4. The portable jib of claim 3, wherein the support bar is an elongate tube.

5. The portable jib of claim 3, wherein the mast is an elongate tube.

6. The portable jib of claim 1, wherein the boom comprises a coupling member configured for coupling to the free end of the support member and a load arm extending substantially radially outward from the coupling member, the load arm defining a free end of the boom.

7. The portable jib of claim 6, wherein the coupling member comprises a tube for receiving the free end of the support member.

8. The portable jib of claim 6, wherein the boom includes a hoist plate attached to a free end of the load arm.

9. The portable jib of claim 1, and further comprising a hoist attached to a free end of the boom.

10. The portable jib of claim 9, and further comprising a rigging device attached to the hoist.

11. The portable jib of claim 1, wherein the boom is rotatably coupled to the support member.

12. The portable jib of claim 11, wherein the boom is capable of rotating 360 degrees about the support member.

13. The portable jib of claim 11, wherein the portable jib has a weight of about 360 pounds.

14. A portable jib for movably mounting to a crane girder including a beam having an upper portion and a rail positioned on the upper portion, the portable jib comprising:

a base frame configured for traveling along the girder;

wherein the base frame includes a pair of end trucks spaced apart and located on opposite sides of the rail;

wherein each end truck has at least one wheel for supporting the base frame on the beam upper portion on opposite sides of the rail and horizontally traveling along the girder;

wherein each end truck includes at least one guide plate extending inwardly below the beam upper portion to receive the beam upper portion for mounting the base frame to the girder and guiding the base frame along the girder:

a support member coupled to the base frame, the support member including a support bar extending between and coupled to the end trucks and a mast extending substantially upward from the support bar;

a boom rotatably coupled to a free end of the mast, the boom including an attachment means at a free end of the boom, wherein the boom extends substantially radially outward from the mast; and wherein the base frame, the support member and the boom are assembled and mounted to the girder for use and disassembled and removed from the girder after use.

15. The portable jib of claim 14, and further comprising a hoist attached to the attachment means of the boom.

16. The portable jib of claim 15, and further comprising a rigging device attached to the hoist.

17. The portable jib of claim 14, wherein the portable jib has a weight of about 360 pounds.

18. The portable jib of claim 14, and further comprising a support plate mounted to each end truck, each support plate extending between the respective end truck and the support bar.

19. The portable jib of claim 14, wherein the boom comprises a coupling member configured for coupling to the free end of the mast and a load arm extending substantially radially outward from the coupling member, the load arm defining a free end of the boom.

20. The portable jib of claim 19, wherein the coupling member comprises a tube for receiving the free end of the mast.

21. A method for removing and installing components of a crane, the crane including a girder including a beam having an upper portion and a rail positioned on the upper portion, the method comprising the steps of:

assembling a portable jib on the girder of the crane wherein the jib is configured for engaging the beam upper portion on opposite sides of the rail and horizontally traveling along the girder;

coupling a hoist to the jib, the hoist for raising and lowering loads to and from the crane;

utilizing the hoist to raise and load the crane or lower a load from the crane; and disassembling the jib to remove the jib from the girder.

22. The method of claim 21, wherein assembling the jib comprises the steps of:

mounting a base frame to the girder, wherein the base frame includes wheels for supporting the jib on the beam upper portion and facilitating travel of the jib along the girder;

coupling a support member to the base frame wherein the support member extends substantially upward from the base frame; and coupling a boom to a free end of the support member wherein the boom extends substantially radially outward from the support member, the boom including an attachment means at a free end for coupling the hoist to the boom.

23. The method of claim 22, wherein the boom is rotatably coupled to the free end of the support member.

24. The method of claim 22, wherein disassembling the jib comprises:

decoupling the boom from the support member;

de-coupling the support member from the base frame; and removing the base frame from the girder.

25. The method of claim 21, and further comprising coupling a rigging device to the hoist for facilitating raising and lowering of loads to and from the crane.

* * * * *